CERAMIC CORE FOR USE IN MAKING MOLDS AND DIES

This application is a continuation-in-part of copending application Ser. No. 406,440, filed Oct. 15, 1973, which is a continuation-in-part of application Ser. No. 263,082, filed June 15, 1972, which is now abandoned.

It is known to produce molds and dies, particularly for the plastics industry, as well as various compacted articles such as jet engine components, from die steels and superalloys. Conventionally, this is achieved with molds and dies by producing a wooden model or pattern of the desired finished part. From this pattern die replicas are produced for use in rough machining blocks of the desired alloy by die sinking. After rough machining the part is subjected to further finish machining to the desired mold or die configuration. Because of the extensive machining required, this practice is extremely expensive. Consequently, it has been proposed to produce molds and dies by a powder metallurgy technique. In this practice a core of ceramic material that is shaped to the configuration desired in the final mold or die is used. The ceramic core, having the desired configuration, is placed in a container wherein the surface of the core constituting the desired mold or die configuration is placed adjacent a charge of alloy particles of the composition desired for the mold or die. After evacuating the container to remove any moisture present therein, the container is sealed against the atmosphere and the charge is heated to a compacting temperature typically within the range of 1800° to 2300° F. While at this temperature the container and charge are compacted, preferably by the use of isostatic pressure, which is achieved by placing the container within a fluid pressure vessel of the well-known type. Compacting is achieved to provide densities approaching 100% of theoretical. After compacting is completed to final high density, the ceramic core is removed from the compacted charge to expose the adjacent compacted surface of the charge which now constitutes a mold or die cavity with a configuration corresponding to that of the ceramic core.

In this practice, it is advantageous from the cost standpoint to have a ceramic core that may be completely and easily removed to expose the mold or die cavity after compacting. Ideally, the ceramic core should be completely removable by either a brief sandblasting operation or ideally by wire brushing. If long-time removal operations are required for the core this adds substantially to the overall cost of the mold manufacture, much like the extensive machining practices required in earlier mold and die making operations. Also, the ceramic core should be of a composition that may be readily cast into the exact configuration required for the many intricate mold and die shapes required. Furthermore, so that the required close tolerances may be maintained in mold and die manufacture, it is necessary that the ceramic core when subjected to the high temperatures and pressures during compacting not experience significant deformity as by shrinkage or otherwise.

It is accordingly the primary object of the present invention to provide a ceramic core that may be readily cast to the close tolerances required for compacted articles, such as molds and dies, and will experience minimal size change upon compacting at elevated temperature and after compacting may be easily removed from the mold or die cavity of the compacting.

These and other objects of the invention, as well as a complete understanding thereof, may be obtained from the following description and specific examples.

Broadly, in the practice of the present invention it has been found that ceramic cores having the desired properties for use in the above-described powder metallurgy technique for producing compacted articles such as molds and dies may be obtained by the use of an admixture of rounded refractory oxide particles and colloidal silica as a binding agent. The rounded refractory oxide particles may be zircon, alumina and silica, with zircon sand being preferred. Zircon sand is preferred because its naturally occurring form is spherical particles within a size range of −100 + 325 mesh (U.S. Standard). The term "rounded refractory oxide particles" means that the particles are of nonangular configuration which would include but not be limited to spherical particles. The binding agent is colloidal silica.

Although any of the commercially available colloidal silica products are suitable for the purpose, the following NALCOAG 1050 colloidal silica available from Nalco Chemical Company is an example of material suitable for the purpose:

| Grade | NALCOAG 1050 Concentrated |
|---|---|
| Specific Gravity Min. at 68° F | 1.380 |
| Average particle size millimicrons, by titration | 16–25 |
| pH Beckman Meter Model Zeromatic | 9.0 ± .2 |
| Conductivity at 64° F mmh maximum | 6000 |
| Viscosity Cps 77° F. maximum | 70 |
| $SiO_2$ | 49% by Wt. |
| $H_2O$ | 51% by Wt. |
| Alcohol | 0 by Wt. |
| $Na_2O$ | .3% by Wt. |
| Pounds per gallon | 11.5 |
| Freezing Point | 32° F |
| Specific Surface Area $m^2$ per gram by titration | 190–120 |

The admixture in accordance with the invention may comprise 80 to 98% by weight of spherical refractory oxide particles and 2 to 20% by weight of colloidal silica as a binding agent. When zircon sand is used the size consist will range between −100 and + 200 mesh.

In the manufacture of ceramic cores in accordance with the present invention, initially a "green" compact of an intermediate density is produced. This "green" or intermediate core product is of a configuration generally corresponding to that desired in the final mold or die but oversized to a degree corresponding to the deformation achieved by subsequent shrinkage during high temperature fusing. The "green" compacts may be produced by casting the admixture into a plastic-type mold, freezing at temperatures of about −70° F. and then removing the mold. It has been found that by subjecting this material to these low temperatures sufficient cohesion is achieved in the "green" compact to permit handling. Final densities are achieved by heating the intermediate compact for times on the order of about 15 minutes at temperatures within the range of 1500° to 2300° F. With this time at temperature the material fuses to a coherent, dense mass which may then be used in accordance with the powder metallurgy practice for producing molds and dies described hereinabove.

By the use of spherical refractory oxide particles, and preferably zircon sand, the core may be easily removed from the compacted alloy to expose the die cavity after compacting. For this purpose a short sand blasting oper-

United States Patent [19]

Chandhok

[11] 4,139,393

[45] Feb. 13, 1979

[54] CERAMIC CORE FOR USE IN MAKING MOLDS AND DIES

[75] Inventor: Vijay K. Chandhok, Pittsburgh, Pa.

[73] Assignee: Crucible Inc., Pittsburgh, Pa.

[21] Appl. No.: 791,822

[22] Filed: Apr. 28, 1977

Related U.S. Application Data

[63] Continuation-in-part of Ser. No. 406,440, Oct. 15, 1973, which is a continuation-in-part of Ser. No. 263,082, Jun. 15, 1972, abandoned.

[51] Int. Cl.[2] ..... B28B 7/34

[52] U.S. Cl. ..... 106/38.3; 106/38.9; 106/65; 106/69

[58] Field of Search ..... 106/38.3, 38.35, 38.9, 106/65, 69

[56] References Cited

U.S. PATENT DOCUMENTS

| | | | |
|---|---|---|---|
| 3,445,250 | 5/1969 | Preece | 106/38.3 |
| 3,512,571 | 5/1970 | Phelps | 106/38.3 |
| 3,537,949 | 11/1970 | Brown et al. | 106/38.3 |
| 3,656,983 | 4/1972 | Sulinski | 106/38.3 |

*Primary Examiner*—Lorenzo B. Hayes

[57] ABSTRACT

Compacted articles, such as molds and dies, may be produced by compacting an alloy particle charge of a composition from which it is desired to make the mold and die against a ceramic core having a configuration corresponding generally to the desired configuration of the article; the ceramic core of the invention is constructed from an admixture comprising rounded refractory oxide particles and a colloidal silica as a binding agent; preferably the rounded refractory oxide particles are zircon sand. Cores in accordance with the invention are readily cast into precision shapes required for mold and die manufacture and also are easily removable from the compacted alloy such as molds or dies to expose the mold or die cavity.

5 Claims, No Drawings